US005887541A

United States Patent [19]

Jaki et al.

[11] Patent Number: 5,887,541

[45] Date of Patent: Mar. 30, 1999

[54] ARRANGEMENT IN MANUALLY CONTROLLABLE DISPLAY EQUIPMENT FOR THE ARRESTING OF INDICATING ELEMENTS PROVIDED WITH PERMANENT MAGNETS, AND SET TO PIVOT ABOUT AXES COINCIDENT WITH THEIR MEDIAN

[76] Inventors: Laszlo Jaki, Kosztolanyi tér 12, 1114 Budapest; Sandor Szenassy, Pitvar u.3, 1141 Budapest; Laszlo Szidor, Krivan u.8, 1142 Budapest, all of Hungary; Jessie D. Swinea, 222 W. Lasale, Royal Oak, Minn. 48073

[21] Appl. No.: 602,836

[22] PCT Filed: Jun. 24, 1994

[86] PCT No.: PCT/HU94/00022

§ 371 Date: Oct. 7, 1996

§ 102(e) Date: Oct. 7, 1996

[87] PCT Pub. No.: WO95/02229

PCT Pub. Date: Jan. 19, 1995

[30] Foreign Application Priority Data

Jun. 30, 1993 [HU] Hungary ..... P 93 01901

[51] Int. Cl.[6] ..... G09F 9/37; G09F 9/30

[52] U.S. Cl. ..... 116/311; 116/318; 40/449

[58] Field of Search ..... 40/449, 492, 506; 116/309, 310, 311, 312, 313, 314, 315, 316, 317, 318, 204, 205, 267, 303; 200/339, 553, 556; 73/DIG. 5

[56] References Cited

U.S. PATENT DOCUMENTS

| | | | |
|---|---|---|---|
| 3,430,170 | 2/1969 | Shatas et al. . | |
| 3,855,959 | 12/1974 | Hinze | 116/303 |
| 4,457,171 | 7/1984 | Gebauer | 73/305 |
| 4,483,193 | 11/1984 | Bonetti | 73/313 |

FOREIGN PATENT DOCUMENTS

| | | | |
|---|---|---|---|
| 1492312 | 7/1967 | France | 116/204 |
| 108281 | 4/1964 | Netherlands | 200/339 |
| WO 93/09527 | 5/1993 | WIPO . | |
| WO 93/09528 | 5/1993 | WIPO . | |

*Primary Examiner*—Elizabeth L. Dougherty
*Assistant Examiner*—Willie Morris Worth
*Attorney, Agent, or Firm*—Brooks & Kushman P.C.

[57] ABSTRACT

Display devices are disclosed using a display surface through which are seen a plurality of indicating elements. The indicating elements have an axis parallel to the display surface and are provided with at least two information display faces preferably of different colors. The indicating elements are provided with permanent magnets and are rotatable about axes which allow alternative faces of the indicating elements to be viewed through the display surface. Locking elements are provided so that the indicating elements are maintained with one of the information carrying faces aligned with the display surface. The arresting elements may include a permanent magnet. The arrangement is particularly applicable for manually-controlled signal display devices.

9 Claims, 1 Drawing Sheet

ARRANGEMENT IN MANUALLY CONTROLLABLE DISPLAY EQUIPMENT FOR THE ARRESTING OF INDICATING ELEMENTS PROVIDED WITH PERMANENT MAGNETS, AND SET TO PIVOT ABOUT AXES COINCIDENT WITH THEIR MEDIAN

Arrangement in manually controllable display equipment for the arresting of indicating elements provided with permanent magnets, and set to pivot about axes coincident with their median, in which arrangement there are a base plate and indicating elements pivoting about an axis coincident with their median and parallel to the plane of the base plate, which indicating elements are fitted with at least two information-carrying faces preferably of different colors, each face suitable to convey information differing from the other and set to be pivoted into alignment with the display surface of, the base plate and the magnetic axis of the permanent magnet in each indicating element is set perpendicular to the axis of the indicating element.

We are familiar with certain kinds of display equipment using passive indicating elements—such as described in the Hungarian patent application No. 3460/91, where the indicating elements are one or other specific shape and so formed to be pivoted about an axe coincident with their median, and the angle between their two extreme rotating positions being 90 degrees. The space between these two end-surfaces is completely filled by an indicating body and the middle section or whole width of this component has been permanently magnetized. Since, due to the effects of shading, the magnetic fields arising with this design do not permit miniature forms, this kind of display element is employed only in the segments of segmented display equipment.

The indicating elements under discussion, however, are also capable of being rocked over manually for rewriting of a text, for example using a magnetic pencil. In this case, however, it is necessary to ensure that the corrections so made are maintained stable, despite the action of removing the rewriting instrument from the vicinity of the indicating elements.

The aim of the invention is to correct the shortcomings in arresting of indicating elements, and to create such arresting instruments that will adequately ensure that corrections made to information are maintained reliably.

The basis of the invention is the realization that it is possible, when setting the indicating elements manually using a magnetic instrument—for example a magnetic pencil—to achieve the setting of each in one or other extreme position with soft-iron components, preferably able to be slid in a direction perpendicular to the base plate and with solid magnetic elements to be both slid in this direction and pivoted.

The essence of the invention is:

the indicating elements (1) have arresting appliances to arrest the movement of the indicating elements (1), which arresting appliances arranged in the opposite side of the display surface of the base plate (5), either fitted with permanent magnets or magnetizable themselves, the magnetic axes (4) of the permanent magnets in the indicating elements (1) form an acute angle with the base plate (5).

Here follows a more detailed description of this invention, with the help of different form of performance, illustrated in the accompanying drawing, in which:

BEST MODE FOR CARRYING OUT THE INVENTION

Figure 1:
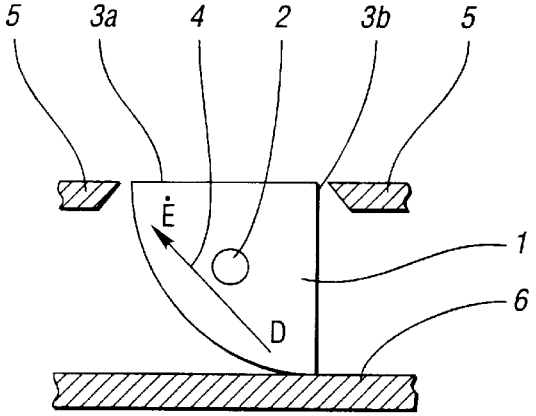
FIG. 1 shows arresting with soft-iron plate.
Figure 2:
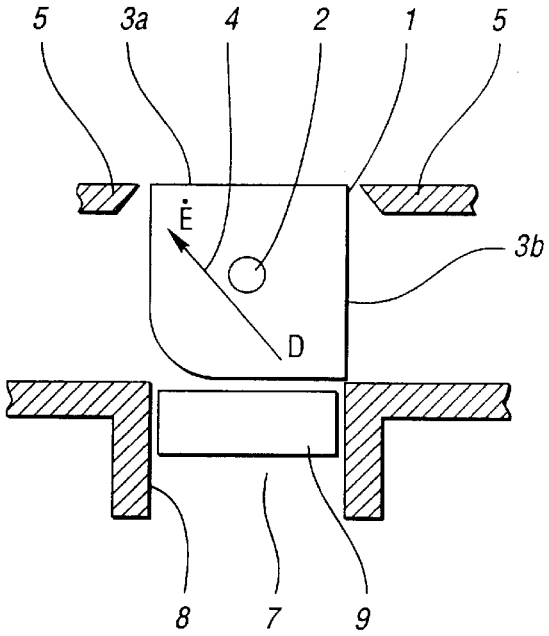
FIG. 2 shows arresting with soft-iron cylinder.
Figure 3:
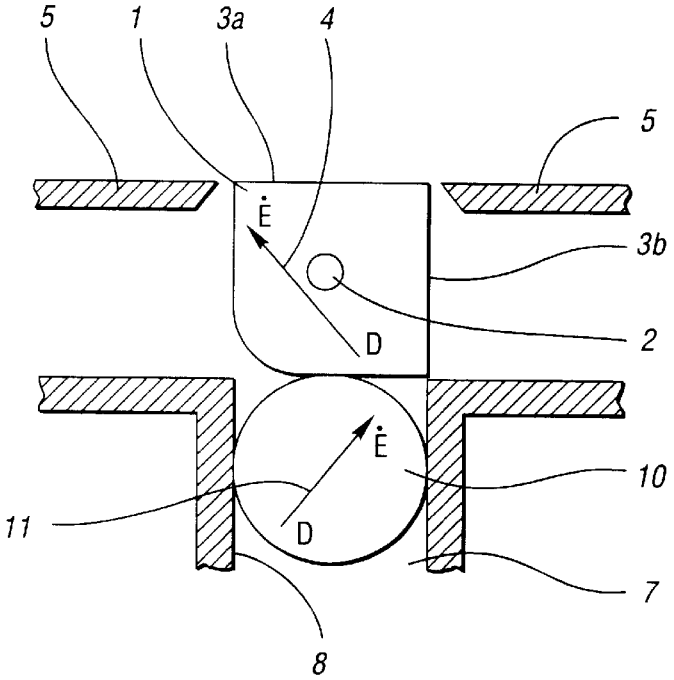
FIG. 3 shows arresting with a sphere, provided with permanent magnet.

The indicating element 1 of specific shape, shown in FIGS. 1–3 is prism-shaped and preferably formed to be pivoted about an axis 2 coincident with its median. One edge of the display element 1 is rounded off and those two sides of it which form the edge diagonally opposite the rounded edge form information-carrying surfaces 3*a*, 3*b* preferably of different colors. Embedded within the indicating element 1, there is a permanent magnet, the magnetic axis 4 of which forms an angle preferably of 45 degrees with the two information-carrying surfaces 3*a*, 3*b* of the indicating element 1, while being perpendicular to the axes 2 about which the indicating element 1 rocks. This axes 2 is arranged parallel with base plate 5.

In the case of manual-control, e.g. with a magnetic pencil, it is necessary for the indicating element 1 to be arrested bistably into its one or other extreme position. As seen in the forms of performance, the arresting is effected by closing the magnetic circuit with the aid of an arresting instrument.

The simplest case can be seen in FIG. 1, where the arresting instrument is a soft-iron plate 6, positioned parallel to the base plate 5, at a distance which permits the pivoting of the indicating element 1, while the rolling face of the indicating element 1, which surface may be brought into contact with the soft-iron plate 6, is a cylinder jacket with its axis coincident with the axis 2 of the indicating element 1. When the indicating element 1 pivots through 90 degrees from the position shown in FIG. 1, the indicating element 1 pivots counter-clockwise such that its North pole comes into the vicinity of the soft-iron plate 6. This arrangement provides a successful mechanism only if the soft-iron plate 6 is in contact with the indicating element 1 throughout the duration of pivoting that is to say: if the rolling face, between the edges of the two information-carrying surfaces 3*a*, 3*b* of the indicating element 1, has the form of a quadrant cylinder jacket.

This problem may be solved by employing the solution shown in FIG. 2. Behind every indicating element 1, an opening 7 is formed in the opposite side of the display surface of the base plate 5. In this opening 7 is a cylinder or prism-shaped arresting element 9 made out of soft-iron capable of moving in the direction perpendicular to the display surface of the base plate 5 and making a loose fit with the wall 8 of the opening 7. This cylinder or prism-shaped arresting element 9, since it may be slid backwards, is always in contact with the indicating element 1 and, when the indicating element 1 is in its extreme positions, bears up—neglecting the rounded edge—its whole surface on the indicating element 1.

If the arresting element 9 shown in FIG. 2 is a cylinder containing a permanent magnet whose magnetic axis is parallel with the surface of the base plate 5, the opening 7 is preferably cylindrical in form and arresting is achieved as the cylinder pivots through 180 degrees about its own axis.

For the sake of the present description, the term cylinder is used to mean a discoid form, whose height is significantly smaller than its diameter, although it may be also a body suitable for rotation in the opening 7, especially a body rotation. In the two extreme positions, the magnetic axis 4 of the permanent magnet is perpendicular to the axis 2. We have not illustrated this case.

If the arresting as shown in FIG. 3 is a spherical arresting element 10 which similarly makes a loose fit with the wall 8 of the opening 7, then the arresting may be made more reliable by virtue of the permanent magnet, magnetized along its diameter, and which is placed into the sphere. In this case, whenever the indicating element 1 pivots through 90 degrees, the spherical arresting element 10 also turns through approximately 90 degrees and reliably arrests the movement of the indicating element 1 at its extreme position. In the cases of extreme positions of the indicating element 1, the magnetic axis 11 of permanent magnet placed inside of the spherical arresting element 10 makes an angle of approximately 45 degrees with the plane of the base plate 5 and is perpendicular to the axis 2, that is to say: it is in the same plane wherein the magnetic axis 4 of the permanent magnet placed in the indicating element 1.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. An arrangement in manually controllable display equipment for the arresting of indicating elements provided with permanent magnets, and set to pivot about axes coincident with their median, comprising:

a base plate with a display surface;

a plurality of indicating elements each pivotable about an axis coincident with their median and parallel to the plane of the base plate;

each indicating element with at least two information-carrying faces, each face suitable to convey information differing from the other and set to be pivoted into a position aligned with to the display surface;

a permanent magnet with a magnetic axis in each indicating element, the magnetic axis of the permanent magnet in each indicating element set perpendicular to the axis of the indicating element and at an acute angle to the base plate display surface;

an arresting element for each indicating element interacting with the permanent magnet of the indicating element to arrest the movement of the indicating elements; and the arresting element being a soft-iron plate, positioned parallel to the base plate, at a distance which permits the pivoting of the indicating element, where the pivoting of the indicating element is occasioned by contact between the soft-iron plate and a rolling face of the indicating element, which is in the form of a cylinder jacket having its axis coincident with the axis of the indicating element.

2. An arrangement in manually controllable display equipment for the arresting of indicating elements provided with permanent magnets, and set to pivot about axes coincident with their median, comprising:

a base plate with a display surface;

plurality of indicating elements each pivotable about an axis coincident with their median and parallel to the plane of the base plate;

each indicating element with two discrete information-carrying faces, each face suitable to convey information differing from the other when pivoted into a position aligned with the surface of the base plate;

a permanent magnet with a magnetic axis in each indicating element, the magnetic axis of the permanent magnet in each indicating element set perpendicular to the axis of the indicating element and at an acute angle to the base plate display surface; and an arresting appliance for each indicating element interacting with the permanent magnet of the indicating element to alternatively arrest the movement of the indicating elements to show either one or the other of the information carrying faces when one of its faces is in a position aligned with the surface of the base plate.

3. Arrangement as claimed in claim 2, characterized in that the arresting device is a soft-iron plate, positioned parallel to the base plate, at a distance which permits the pivoting of the indicating element, where the pivoting of the indicating element is occasioned by contact between the soft-iron plate and a rolling face of the indicating element, which is in the form of a cylinder jacket having its axis coincident with the axis of the indicating element.

4. Arrangement as claimed in claim 2, characterized in that behind the indicating elements, away from the base plate, are openings which receive and guide the arresting elements so that the arresting elements can move perpendicularly in relation to the base plate.

5. Arrangement as claimed in claim 4, characterized in that the arresting elements, to be guided by the openings, have a cylindrical form, are made out of soft-iron so to be capable of being partially magnetized and are suitable to be moved in a direction perpendicular to the base plate.

6. Arrangement as claimed in claim 4, characterized in that the arresting elements, to be guided by the openings, have prism-shaped form, are pivotable about their own axes perpendicular to the base plate and movable in a direction perpendicular to the base plate, and contain an imbedded permanent magnets whose magnetic axes are parallel with the plane of the base plate.

7. Arrangements as claimed in claim 4, characterized in that the arresting elements are spherical, provided with imbedded permanent magnets and are pivotable in the openings, the magnetic axes of the permanent magnets of arresting elements making an acute angle with the base plate when one of its faces of the indicating elements is in a position aligned with the surface of the base plate.

8. Arrangement as claimed in claim 5, characterized in that the magnetic axes of the permanent magnets embedded within the indicating elements and the magnetic axes of the permanent magnets in the cylindrical-shaped arresting elements, lie in the same plane when the faces of the indicating elements are in positions aligned with the surface of the base plate.

9. Arrangement as claimed in claim 7, characterized in that the magnetic axes of the permanent magnets embedded within the indicating elements and the magnetic axes of the permanent magnets in the spherical arresting elements, lie in the same plane when the faces of the indicating elements are in positions aligned with the surface of the base plate.

* * * * *